United States Patent [19]

Garay et al.

[11] Patent Number: 5,053,065

[45] Date of Patent: Oct. 1, 1991

[54] LOW-PROFILE BLOWER AND FILTER APPARATUS FOR SUPPLYING CLEAN AIR

[76] Inventors: Charles J. Garay, 480 Stalevicz La., Rahway, N.J. 07065; Anthony J. Romayo, 32 Park Pl., Middletown, N.J. 07701; David McClelland, 236 McFarlane Rd., Colonia, N.J. 07067

[21] Appl. No.: 194,395

[22] Filed: May 16, 1988

[51] Int. Cl.[5] ..... B01D 46/00

[52] U.S. Cl. ..... 55/470; 55/385.2; 55/473

[58] Field of Search ..... 55/467, 470, 472, 473, 55/500, 385.2

[56] References Cited

U.S. PATENT DOCUMENTS

| | | | |
|---|---|---|---|
| 3,080,695 | 3/1963 | Hay | 55/470 X |
| 3,217,470 | 11/1965 | Omohundro | 55/470 X |
| 4,560,395 | 12/1985 | Davis | 55/473 X |

OTHER PUBLICATIONS ebm Industries, Inc. "Motorized Impellers for 2x4 Ceiling Mounted HEPA Filters Clean Room Modules" 4–1987.

*Primary Examiner*—Bernard Nozick

[57] ABSTRACT

Low profile blower and filter apparatus for supplying clean air to selected environments is configured wherein a relatively low powered blower unit employing a backward curved impeller is utilized for a selected unit of volume. The number of blower units employing the backward curved impeller within the given module is determined as a function of the number of selected units of volume in the blower and filter module configured. Each blower unit employing a backward curved impeller produces a radial air flow which pressurizes a plenum formed within the module configuration in a substantially uniform manner enabling a substantially laminar flow through a filter disposed perpendicularly to the direction of the air flow from the backward curved impeller without use of baffles. Since the blower units selected are relatively small and no baffle structure need be employed, the height dimension of the resulting unit is markedly reduced to obtain a low profile module.

2 Claims, 4 Drawing Sheets

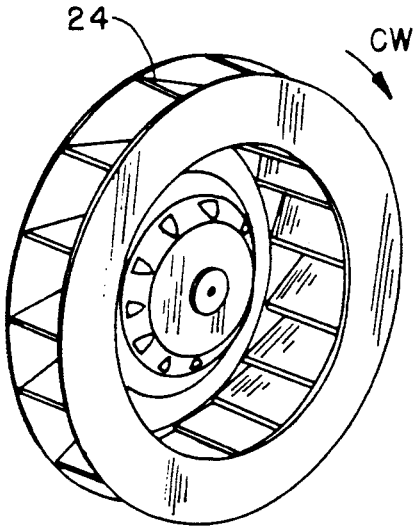
FIG. 6
FIG. 7
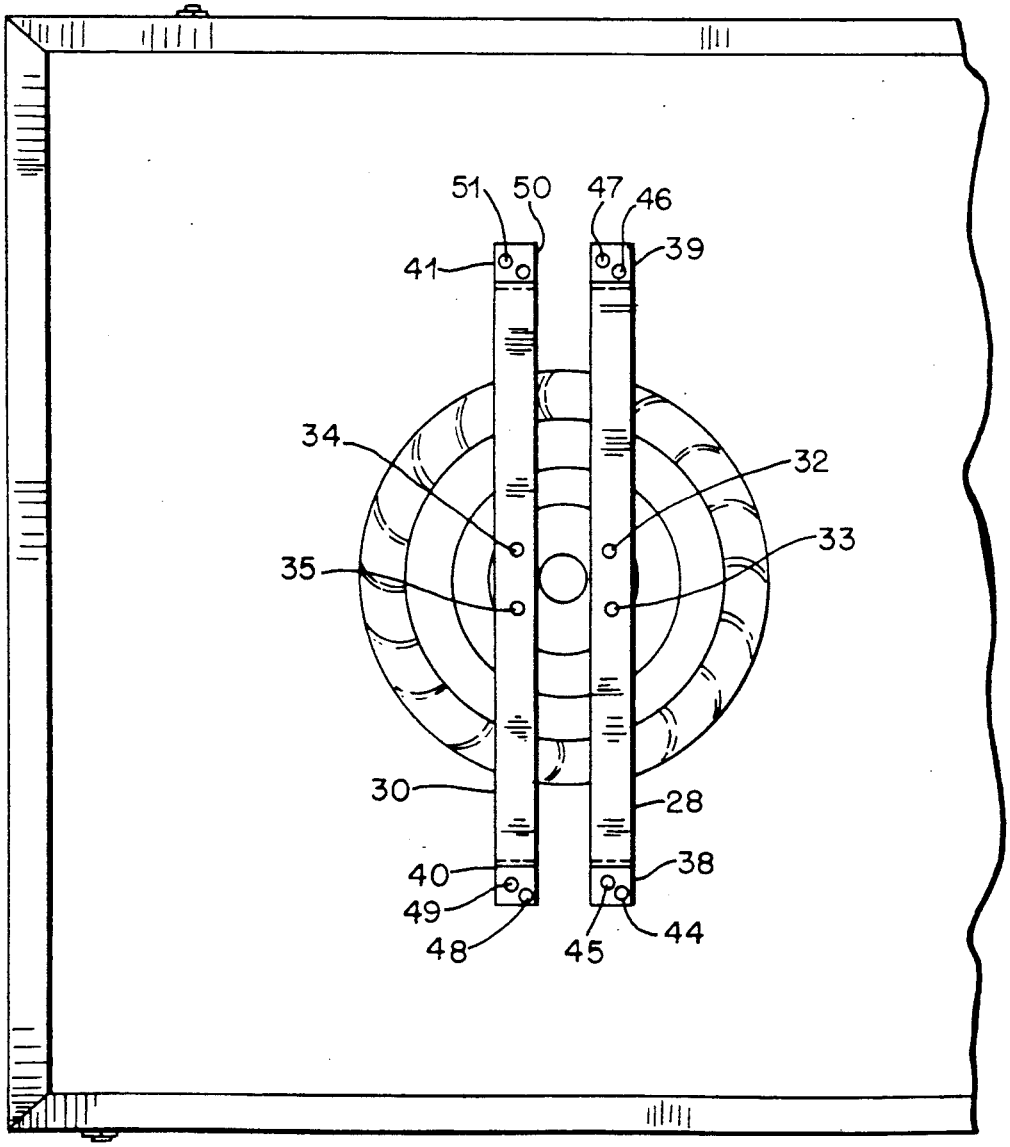

LOW-PROFILE BLOWER AND FILTER APPARATUS FOR SUPPLYING CLEAN AIR

BACKGROUND OF THE INVENTION

This invention relates to blower and filter apparatus for supplying clean air to a defined environment and more particularly to highly compact blower filter module arrangements configured on a unit volume basis which employ blower units having backward curved impellers.

Industrial and governmental requirements for clean room standards in many types of work environments have greatly increased. For example, in the electronics industry such diverse applications as the manufacture of magnetic hard disks, semiconductor integrated circuits, discrete electrical components, and various forms of electronic displays require clean room standards which to a large degree surpass those present in medical operating theatres. This has occurred because an occurrence as common as the presence of a single human hair, a substantial number of dust particles, or other common forms of airborne debris will frequently cause the self-destruction of the article manufactured. Therefore, it is of paramount importance that onerous clean room standards be imposed in environments of this type. Corresponding examples occur in the drug and pharmaceutical industry, in medical laboratories, and almost any form of application where airborne contamination is a problem due to the nature of the product or component being produced or utilized.

Since it is rare that entire facilities are provided with a decontaminated air supply, and even if it is, that the entire staff be required to wear clean room garb, the usual approach is to establish individual clean rooms and/or work stations meeting clean room requirements within selected manufacturing locations. In these clean rooms and at such work stations, the limited number of tasks requiring assembly or processing in a particle free environment are performed. The clean room will traditionally take the form of an enclosed space wherein all air introduced is filtered according to HEPA or ULPA standards. Similarly, independent work stations which may be employed in connection with a clean room or as an external work station are provided with a hood which effectively continuously imposes a laminar flow of filtered air about the assembly or processing location of the work station.

Because clean rooms, which are created after the fact, often have tight ceiling restrictions as do the work stations similarly created, it is important that the blower filter units employed to introduce purified air be compact in the height dimension. The ability to quickly and easily replace the filters of such units, on a periodic basis, is also important as is the ability to replace blower units which have failed. This occurs since down time associated with blower filter modules often results in disruption of the manufacturing or assembly operations taking place within the clean room and/or at the work station.

Typical clean room construction involves the creation of an enclosed volume defined by a number of walls, a floor, and a ceiling having blower filter modules arranged in the ceiling to create a continuous flow of clean air through the environment. This flow is frequently laminar in nature and exhaust ports may be provided to remove air from the room. Work stations employ similar blower filter units mounted in the hood above the work surface and differ from the clean room in that the work station is typically not enclosed. Clean air work stations within clean rooms may also be utilized to achieve improved results.

The blower filter units utilized generally take the form of a blower unit disposed to introduce air into a plenum formed between a blower unit and a filter which typically takes the form of a HEPA or ULPA filter. ULPA filters are capable of 99.9995% efficiency for particles of 0.12 microns and larger while HEPA filters are typically 99.99% efficient for particles of 0.3 microns and larger. The blower units are sized to provide ultraclean unidirectional air at class 10 (ULPA) or class 100 (HEPA) requirements.

Since a class 100 flow rate has the imposed requirement of 90 feet/min.± 10 feet/min at the output of the filter, it will be seen that the blower units employed are frequently quite substantial in size. This is particularly so since typical HEPA filters, for example, exhibit static pressures which can range from 0.5 inch to 1.3 inch water gauge. Thus, the blower unit must have sufficient operating power to create a pressure at the input to the filter to overcome the static pressure exhibited by the filter to achieve the requisite flow rate at the output side of the filter. For these reasons, it is not atypical that such blower units have power ratings which are quite substantial. This is particularly so where traditional forward curved impellers are employed since the same operate against a static pressure load and will overload the motor if that static pressure load is exceeded.

All blower units of this type have size and weight parameters which increase in a direct and non-linear fashion with respect to their power rating. As a result, the filter blower units tend to have a substantial height requirement, often exceeding 12 inches, and weight requirements which are incompatible with a simple hang mounting within a T-grid ceiling or the like. Accordingly, special height and support accommodations are often required especially where pre-filter arrangements are provided at the input to the blower unit.

The height and weight characterisitics of blower filter units of the type described often prove so onerous with respect to clean air installations having limited ceiling clearance and work station construction, that many approaches have been taken to lower the profile thereof. For example, motorized impellers have been employed to shrink the height dimension of the motor and in this way, fold the space required by a normal blower arrangement having an impeller connected to the extending shaft. Similarly, baffle arrangements have been employed in connection with the plenum so that the path of air flow from the impeller may also be folded. Such an approach is illustrated in U.S. Pat. No. 4,560,395 which issued on Dec. 24, 1985 to George P. Davis.

The use of a motorized impeller while clearly capable of reducing the space required by a more conventional motor impeller arrangement, in no way reduces the weight and size associated therewith since a relatively large motor must still be employed. Therefore, the height reduction, while substantial is limited.

Use of complex baffle arrangements are also disadvantageous since the presence, installation, and materials associated with these baffle arrangements increase the weight and cost of the resulting blower filter assembly and add difficulty to the maintenance thereof in cases where the blower unit must be replaced. In addition, complex baffle structures, no matter how precise, have the attendant difficulty that while the same may be optimized for a given blower filter combination, the characteristics of blowers and filters do not tend to be uniform. Therefore, while a selected baffle configuration may work quite well for a particular blower and filter in a particular unit, variations for a cross-section of manufactured units will cause substantial variations in performance. Thus, unless the baffle structure is optimized for each unit assembled, substantial operating variations on a unit to unit basis will result.

The present invention proceeds from a recognition that relatively low powered, light weight blower units chosen for a selected unit of volume or filter surface area may be employed to achieve low profile blower and filter apparatus for supplying clean air to a selected environment. The number of blower units within a given module is then determined as a function of the number of selected units of volume or the resulting filter surface area in the blower and filter module configured. In preferred embodiments, each blower unit employs a backward curved impeller which produces a radial air flow which pressurizes the plenum formed within the module configuration in a substantially uniform manner enabling a substantially laminar flow through a filter disposed perpendicular to the direction of air flow from the backward curved impeller without the use of baffles. Because the blower units selected are relatively small when compared to a single blower unit having a power rating corresponding to the sum of the smaller units utilized and no baffle structure is required, the height dimension of the resulting module is markedly reduced to achieve a low profile design. Further, since no baffle structure need be employed, optimum performance is acheived with all units despite normal variation in filter and motor blower parameters. In addition, marked cost reductions are acheived due to the absence of the baffle structures and resulting modules are relatively light weight so that no additional ceiling support structure is normally required.

Therefore, it is the principle object of the present invention to provide an improved low profile blower and filter apparatus for supplying clean air to selected environments. Various other objects and advantages of the present invention will become clear from the following detailed description of an exemplary embodiment thereof and the novel features will be particularly pointed out in conjunction with the claims appended hereto.

SUMMARY OF THE INVENTION

In accordance with the teachings of the present invention, a low profile blower and filter apparatus for supplying clean air to a selected environment, is provided wherein a relatively low power blower unit employing a backward curved impeller is utilized for a selected unit of volume or surface area of a filter and the number of blower units employing a backward curved impeller within a given module is determined as a function of the number of selected units of volume or the complete surface area of the filter in the blower and filter module configured. Each blower unit employing a backward curved impeller produces a radial air flow which pressurizes a plenum formed within the module configured in a substantially uniform manner enabling a substantially laminar flow through a filter disposed perpendicular to the direction of air flow from the backward curved impeller without use of baffles. Since the blower units selected are relatively small and no baffle structure need be employed, the height dimension may be markedly reduced to obtain a low profile module.

BRIEF DESCRIPTION OF THE DRAWINGS

The invention will be more clearly understood by reference to the following detailed description of an exemplary embodiment thereof in conjunction with the accompanying drawings in which:

FIG. 6 is a view illustrating the details of the motorized, backward curve impeller employed in the preferred embodiment of the present invention;

FIG. 7 is a breakway view illustrating the details of the mounting for the motorized impeller.

DETAILED DESCRIPTION OF THE INVENTION

Figure 1:
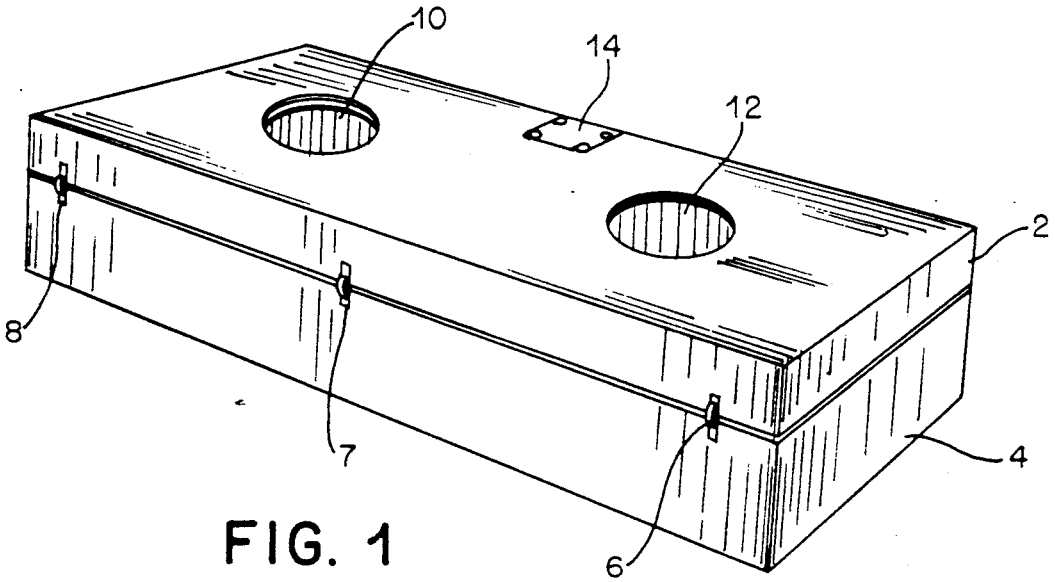
FIG. 1 is a pictorial view of a preferred embodiment of the low profile blower and filter apparatus according to the present invention.

Referring now to the drawings, and more particularly to FIG. 1 thereof, there is shown a pictorial view of the preferred embodiment of the low profile blower and filter apparatus according to the present invention. The exemplary embodiment of the invention illustrated in FIG. 1 is described as configured as a module for insertion into a standard T-grid ceiling having conventional 2'×4' openings for ceiling tiles and in this case, filter blower modules configured in accordance with the embodiment of the invention illustrated in FIG. 1. Under these circumstances nominal dimensions for the embodiment of the invention illustrated in FIG. 1 may be considered to be 4'×2'×9". Further, as shall be seen in greater detail below, in such a unit a design volume for selecting a blower unit is chosen as 2'×2'×9" wherein the blower unit is chosen for a selected CFM at a selected static pressure through a 2'×2' section of a filter. However, the same consideration set forth may be employed for design sizes wherein a selected unit of volume or filter surface area is multiplied by any desired number, including 1, to achieve a selected module.

The embodiment of the invention illustrated in FIG. 1 comprises a backplate box 2 for housing each of the motorized impellers, a filter housing 4, and a plurality of latches 6–8 for selectively interconnecting the backplate box 2 with the filter housing 4 to enable the filter housing to be quickly and easily changed at such times when it is desirable to change the filter. The latches 6–8 may conveniently take the form of over-center draw latches of the type well-known to those of ordinary skill in the art with the three latches illustrated at the front of the assembly being matched by corresponding latches to the rear. While a greater or fewer number of the latches 6–8 may be employed, this number of latches, in the front and rear of the unit and located in the manner illustrated, is wholly adequate to rigidly lock the filter housing 4 to the backplate box 2 facilitating changing of the filter housing 4 in a relatively easy manner and ensuring that quiet, vibration-free operation is obtained. The filter housing 4 employed for the embodiment of the invention being described may have a nominal dimension of 4'×2'×6".

The backplate box 2 has, as illustrated, a pair of inward spun collars 10 and 12 which serve as inlet rings for the air inlets to the motorized impellers which, as shall be seen below, are mounted therebeneath. The backplate box 2, as also indicated in FIG. 1, may be provided with an appropriate box connection 14 for mounting to an electrical box or the like and thereby receive electrical energy for energizing the motorized impellers therein.

Figure 2:
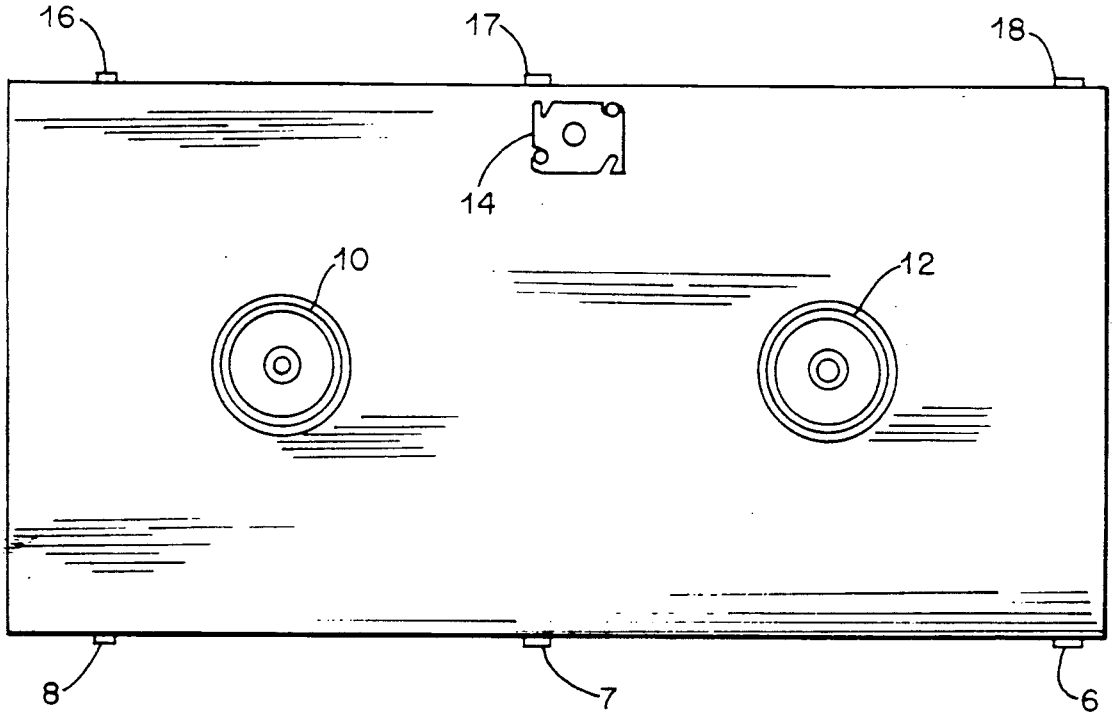
FIG. 2 is a top view of the embodiment of the low profile blower and filter apparatus shown in FIG. 1.
Figure 3:
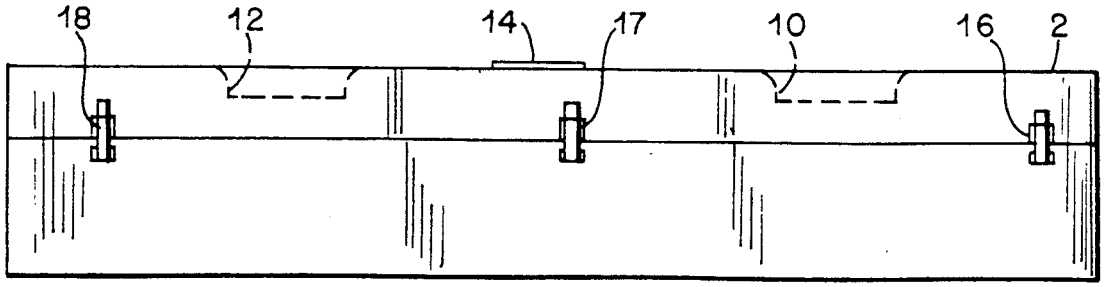
FIG. 3 is a side view of the low profile blower and filter apparatus shown in FIG. 1.

Turning to the top view of the embodiment of the invention shown in FIG. 2 and the front view thereof shown in FIG. 3, it will be seen that each of the inward spun collars 10 and 12 are centrally located within each 2'×2' section of the backplate box 2 wherein the 2'×2' sections when multiplied by the height of the unit forms the selected unit of volume for which the motorized impeller shown generally in FIG. 2 is selected. Thus, for the exemplary 4'×2' unit being depicted each 2'×2'×9" unit of volume is provided with a centrally located motorized impeller as indicated in FIG. 2. The additional latches 16–18 on the opposing side of the module are shown in FIG. 2. In FIG. 3, additional details of the spun collars 10 and 12 are depicted.

Figure 4:
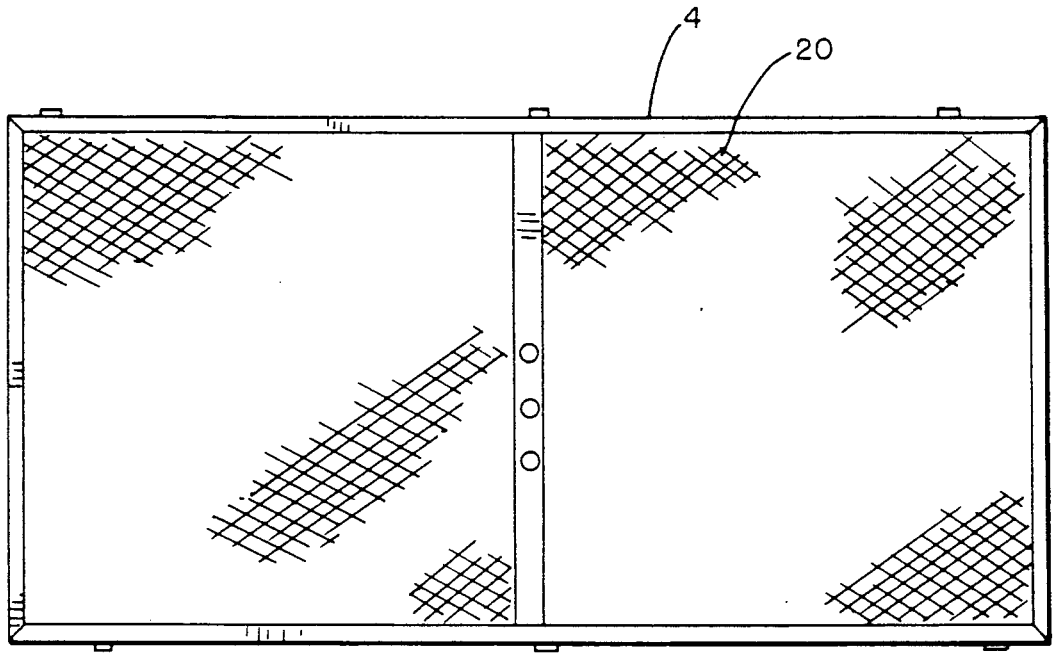
FIG. 4 is a bottom view showing the details of the filter side of the low profile blower and filter apparatus shown in FIG. 1.

Referring now to FIG. 4, there is shown a bottom view of the embodiment of the invention illustrated in FIG. 1 depicting details of the filter 20 as exposed from the filter housing 4. The filter module 20, as also shown in connection with FIG. 5, may take the form of a conventional 70 mm filter pack which is 99.99% efficient on particles of 0.3 microns and larger. Such filters are available in 2'×2', 2'×4', as well as the larger sizes to accommodate the standard 2'×2' unit selected as well as units formed as multiples thereof. Such filter packs are conventionally available from FILTRA Corp. of Hawthorne, N.J. as well as many other manufacturers thereof.

Alternatively, ULPA filters which are 99.9995% efficient on particles of 0.12 microns and larger may be employed as well. When ULPA filters are utilized class 10, rather than class 100, cleaness levels are achieved.

The filter pack is preferably provided to a user within a filter housing 4 so that the same may be readily latched in place as a replacement unit. However, as an alternative, drop-in filter arrangements for the filter housing are readily available.

Figure 5:
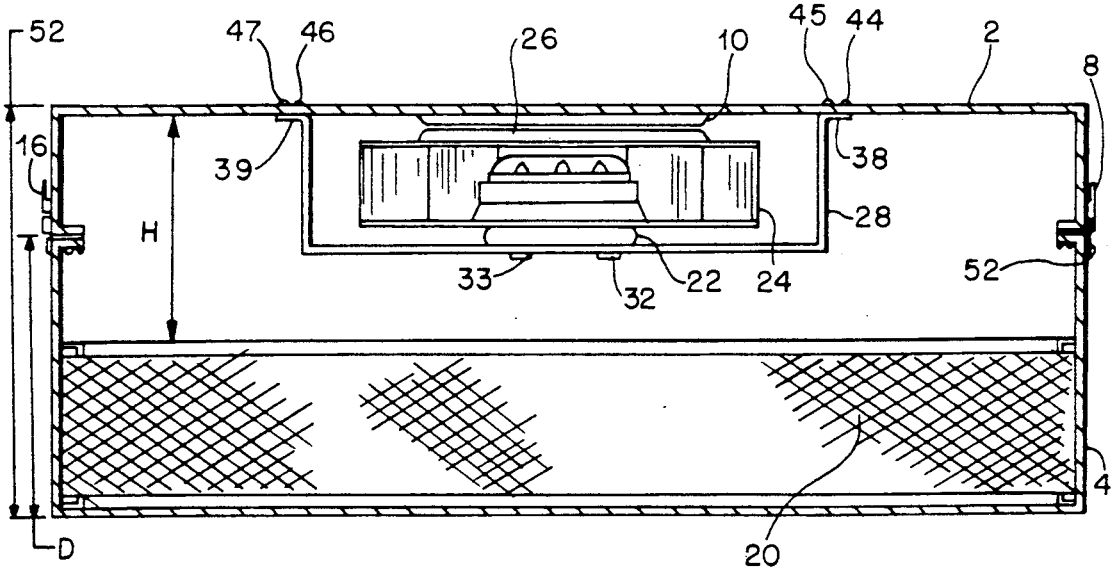
FIG. 5 is a sectional view of the low profile blower and filter apparatus taken along lines A—A in FIG. 2.

Referring now to FIG. 5, there is shown a sectional view of the low profile blower and filter apparatus taken through the section lines A—A in FIG. 2. The motorized impeller 22 is here conventional and is employed for purposes of achieving a reduced mounting profile as is commonly obtained by mounting the impeller in a configuration about the motor so that the spatial requirements of each substantially overlap. For the 2'×2' surface area of the filter which when multiplied by the height dimension H illustrated, FIG. 5 forms the selected unit of volume to be treated, a motor capable of delivering and maintaining 400 CFM from an initial static pressure of approximately 0.4–0.5 inch w.g. (water guage) up to a final static pressure of approximately 1.0 inch w.g. was selected with the intended requirement that this CFM be provided at a rate of 100 fpm 10 fpm with a uniformity throughout the entire filter face so as to conform to class 100 operation as per Federal Standard 209B and IES-RP-CC-002-86 (updated).

The motor 22 is matched with a backward curved impeller 24 as best shown in FIG. 6. The impeller 24 is rotated in the clockwise direction shown in FIG. 6 and thus provides a radial air flow. Backward curved impellers provide a plurality of advantages within the instant invention. More particularly, the same are available with an external rotor motor attached directly to the impeller blades which provides for vibration-free operation and better heat dissipation. In addition, through the use of a backward curved impeller, no blower housing is needed while a radial flow of air is generated directly. Further, through the use of a backward curved impeller a non-loading arrangement is acheived such that whenever a certain level of load is exceeded the motor freewheels not creating any air flow. This should be distinguished from a forward curved impeller blade which operates directly against a static pressure load and will overload the motor if the static load is exceeded.

For example, a type R2E220-AA motor driven impeller arrangement employing a backward curved impeller as available from EBM Industries, Inc. of Unionville, Conn. may be employed. This is an 80 watt motor having a depth dimension of approximately 2¾ inches. This motor has a weight of approximately 2.9 pounds and is thoroughly capable of meeting the design requirements of the 2'×2' ×6" volume of the unit volume selected. As will be apparent from FIGS. 1–3, two of these motorized units will be mounted in the manner illustrated in FIG. 5.

The motorized impeller 22 is mounted with an inlet ring which has an inner diameter of 6.1 inches (or nominally 6 inches) and an outwardly extending fillet at a radius of 0.787 inches to flute open at its widest extreme to a diameter of 9.96 inches. Thus, the inner diameter of the inlet ring 10 is sized proportionately to the inlet diameter of the backward curved impeller 26 to provide an optimized air inlet for the motorized impeller 22.

The motorized impeller 22, is mounted on a pair of brackets 28 and 30, as best shown in FIG. 7. The brackets 28 and 30 are rectangular in shape and are provided with bolts 32–35 for mounting to the motorized impeller as also best shown in FIG. 7. In addition, each bracket 28 is provided with a flanged end portion 38–41, as also best shown in FIG. 7, which is secured to the backplate box 2 with screws or bolts generally indicated as 44–50. The screws or bolts 32–35 may be readily removed when the unit is in place in a ceiling and the motorized impeller 22 replaced. Access is readily provided by the removal of the filter housing 4.

The filter 20 may take the form of a conventional filter module having a depth as indicated by the dimension D of approximately 6" and of this 6" depth the filter 20, per se, has depth of approximately 3". As a result when the filter housing 4 is in place, a pressure plenum having a depth indicated by the arrow annotated H of approximately 6" is established, there being approximately 3" between the bottom portion of the bracket 28 and the filter 20. The filter 20, as aforesaid, may take the conventional form of a 70 mm HEPA filter which exhibits a static resistance of about 0.45 inches water gauge at an air flow of 125 feet/min.

The latches 6–8 and 16–18 as best shown in FIG. 2 may take the conventional form of over the center draw latches or the like enabling the filter housing 4 to be rapidly secured and released from the backplate box 2. This readily facilitates the changing of the filter, the filter housing, or the motorized impeller 22 by providing quick and easy access thereto even when the unit is in place in the ceiling of a clean room or the like. A gasket 52 is provided as indicated on the filter housing 4 to seal the resultant unit and the plenum formed thereby to ensure quiet noise-free operation. In addition, gasket 52 ensures that the pressure plenum formed will not have any air leak which would hamper the efficiency of the unit. An 0.125 inch neoprene gasket or a comparable gasket may be employed for the seal indicated by the gasket 52.

In operation of the filter module described in FIGS. 1–6, it will be seen that air entering through the inlets of each motorized impeller 22 through the inward spun cellars 10 and 12 will be driven or blown radially outward. When this air reaches the sides of the unit, or interacts with the second motorized impeller associated with inlet 10, it will be forced back within the plenum formed between the backplate box 2 and the filter media 20. In this space, indicated by the arrow H, the distance for the dimensions set forth above correspond to a 6" distance which is reduced beneath the motorized impeller 22 and bracket 28 to a 3" distance. As operation continues, air within the plenum formed is pressurized and the pressure will rise essentially uniformly across the surface of the filter 20 within the pressure plenum. Some non-uniformity associated with non-unitormities in the filter may, however, occur. In addition, some turbulence will occur in the chamber forming the pressure plenum where the separate motorized impellers interact.

The pressure will increase until the static resistance of the filter medium 20 here 0.45 in. w.g., is exceeded by the pressure within the plenum. At this time the pressure in the plenum will force air through the filter 20. The flow of air through the filter 20 under these circumstances will occur in a substantially uniform manner and results in uniform air flow through the filter 20 across its entire surface without the need for any baffle structure.

Here the key is to select and employ one motoroized impeller 22 for each predetermined unit of volume within the blower filter module being designed, it being noted that essentially the design criteria is the surface of the filter area being serviced by each motorized impeller. More particularly, the volume associated with this surface area is obtained by multiplying by the height dimension indicated by the arrow H, which is a constant. The height here controls the stacking factor of the air, i.e. how long an interval is required for the pressure being generated within the pressure plenum to exceed the static pressure of the filter 20.

The design criteria of employing one relatively small motorized impeller per unit volume or unit area of the filter 20 to be serviced is highly advantageous in that the sum of the weight, power requirements and dimensions of a plurality of motorized impellers is substantially less than that which would be required for a single motorized impeller capable of providing air flow for a multiple unit module. Thus, in the example set forth a motorized impeller was selected to service a 2'×2' section of the filter in a 4'×2' module. The motorized impeller selected for this purpose has a weight of 2.9 pounds and a height dimension corresponding to 2.75 inches. Its power requirements are 80 watts. A single motor design required to service a 4'×2' area of the filter would typically weigh in the vicinity of 9 pounds and have more than 3 times the power requirements. For example, 2 amps total for the two motors selected in the instant invention versus 9 amps for a single motor design would have much more massive dimensions. Thus, employing relatively small motorized impellers for each selected unit of area of the filter to be serviced or volume within the blower filter module results in a module having less weight, significantly smaller power requirements, and markedly reduced height which translates to a lower profile module which can be more readily accommodated in a T-grid ceiling or the like.

In the design set forth, the distance indicated by the arrow T is essentially 9" where 3" is occupied by the height of the filter media 20. Similarly, 3 inches is occupied by the height of the motorized impeller and bracket 22 and 28. Thus, in the preferred embodiment, the values selected for the parameters associated with the arrow D and the arrow H are each 6" allowing a 3" displacement between the bottom of the motorized impeller 22 and the surface of the filter 20. This three inch distance may be varied by approximately one half an inch without substantially affecting the operation of the blower filter module described above. However, if substantially less of a distance is left between the filter module and the motorized impeller 22, non-uniformity in the flow across the filter occurs since there is insufficient distance between the motorized impeller 22 and the surface of the medium to permit uniform pressurization within the plenum. Increases in these distances are, of course, available; however, the instant invention is particularly well suited to low profile units adapted for insertion in T-grid ceilings or the like where ceiling headroom is at a minimum. Hence, increasing the height dimension would tend to be counter productive.

The manner in which a pressure build up within the pressure plenum is employed to overcome the static pressure of the filter 20 is highly advantageous since substantial uniformity of the laminar flow is obtained once the pressure within the plenum exceeds the static pressure of the filter. Further, this is obtained without the use of any baffles whatsoever which simplifies the design, reduces weight and reduces fabrication costs. Furthermore, while discontinuity in the uniformity of the filter medium 20 may still result in some discontinuity in the laminar flow obtained, avoiding the use of baffles wholly obviates a need to compensate the position or shape of the baffles for discontinuities associated with the operation of the motorized impeller.

Using relatively small motorized impellers distributed in a manner to accommodate specific surface areas or operating volumes within the blower filter module provides the additional advantage of quiet operation. This is so since the backward curved impellers employed tend to be quieter in operation than more normal forward curved impellers. Further, the use of backward curved impellers cannot result in an overload of the motor due to an excess pressure within the plenum. Thus, when the pressure builds up past a design level, the motorized impeller 22 merely free wheels. Accordingly, a lighter, quieter, lower profile, more efficient and cost effective unit results.

It should also be noted that use of the latch mechanisms 6–8 and 16–18 is also highly advantageous. For example, the filter housing 4 can be quickly and easily changed on a periodic basis while the module remains in its ceiling location. In addition, the groove structure associated with the latches tend to compensate for any misalignment when the filter housing is replaced.

While the invention has been described in connection with an embodiment where the filter 20 is provided within the module per se, those with ordinary skill in the art will readily recognize that precisely the same concepts are fully applicable to use of the invention within a work station or the like. Thus, in this type of application the backplate box 2 and the filter housing 4 will often be somewhat separated within the work station so that typically the backplate box 2 would be provided at a first location while the filter housing would be disposed proximate to the work area of the work station. The pressure plenum would be established within the structure of the work station. Those with ordinary skill in the art will appreciate that so long as a sealed environment is maintained between the backplate box mounting the motorized impellers and the filter housing containing the filter precisely the same relationship as in the closed module depicted would result except that more than 3" may be provided between the media and the motorized impellers. This, however, would only serve to increase the stacking factor within the pressure plenum. However, the low profile design associated with the backplate box and the lack of a need for baffles, as well as the light weight and low power requirements associated with the present invention, maintains its highly advantageous character within a work station environment as well.

Figure 8:
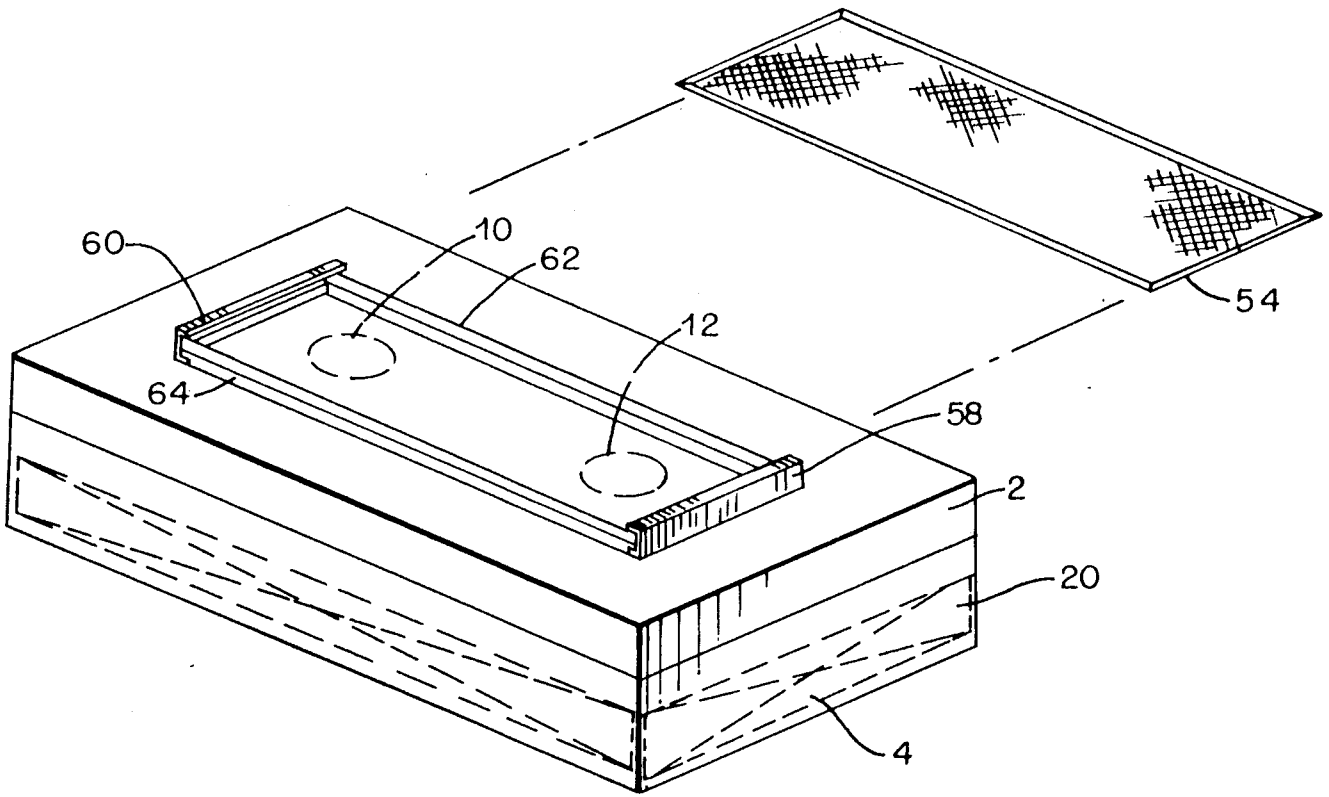
FIG. 8 is an alternative embodiment wherein a prefilter assembly is employed.

Referring now to FIG. 8, there is shown a modified embodiment of the instant invention employing a prefilter assembly at the input or air inlets to the back plate box. Thus, in the modified embodiment illustrated in FIG. 8, a conventional prefilter 54 is mounted over each of the inward spun collars 10 and 12 which serve as air inlets. These collars maybe formed by stamping or the like. The prefilter 54 may take the form of a conventional dry acetate type prefilter having a 12"×36" dimension for example. The backplate box 2 is provided with a series of frame member brackets 58, 60, 62, and 64 for slidably accepting the prefilter 54. The frame members and anterior portions of the brackets may be provided with double faced tape or the like to ensure appropriate sealing and quiet, vibration-free mounting.

The prefilter is generally employed within embodiments of the instant invention as the same increases the life of the filter unit 20 and is thus preferred.

Although the instant invention has been described in connection with a 4'×2' blower filter arrangement employing two motorized impellers, many variations and adaptations will be apparent to those of ordinary skill in the art. For example, a 2'×2' unit would be employed for T-grid ceiling applications configured for ceiling tiles of this size or alternatively a 2'×4' arrangement could be employed in place thereof. Similarly, a 2'×2' surface area is merely exemplary and other predetermined units could be selected as well by shifting the parameters of the motorized impeller unit employed. In addition, multiples greater than 2 are readily available. For example, 4'×4' and similar other arrangements could be readily configured employing the concepts of the instant invention where insertion into T-grid ceilings was not a principle design consideration.

Thus, although the instant invention has been described in connection with a highly specific exemplary embodiment thereof, it will be understood that many modifications and variations thereof will be readily apparent to those of ordinary skill in the art. Therefore, it is manifesly intended that this invention be only limited by the claims and the equivalents thereof.

What is claimed is:

1. Low profile blower and filter apparatus comprising:

filter means having first and second surfaces for receiving air to be filtered and providing a substantially uniform source of filtered air respectively, said filter means exhibiting a predetermined static pressure with respect to air to be filtered applied to said first surface thereof;

motorized impeller means including first and second motors with each motor driving a separate backward curved impeller means, each of said backward curved impeller means when driven by its motor receiving air in an axial direction at an input thereto and providing airflow radially therefrom in a direction transverse to said axial direction, each of said motors with backward curved impeller means being selected to deliver and maintain an airflow at a static pressure exceeding said predetermined static pressure exhibited by said filter means at a rate at least corresponding to federal standards through a predetermined unit of area of said first and second surfaces of said filter means;

housing means for mounting each of said first and second motors with impeller means and said filter means and forming a plenum therebetween, said plenum establishing a sufficient distance between a bottom portion of each of said motorized impeller means and said first surface of said filter means to permit uniform pressurization within said plenum and enable said motorized impeller means to establish uniform airflow across said first surface of said filter means without baffles, said housing means having an inlet means and said motorized impeller means being mounted in said housing means with said input in fluid communication with said inlet means, said housing means having an outlet with said second surface of said filter means in fluid communication with said outlet; and said filter means being sized to a nominal 2' by 4' dimension, said predetermined unit of area is 2' by 2' and said motorized impeller means includes first and second motors each having a backward curved impeller mounted thereon.

2. The low profile blower and filter apparatus according to claim 1 wherein each of said first and second motors is mounted on said housing means centrally disposed over said 2' to 2' predetermined unit of area associated therewith.

* * * * *